US008524434B2

(12) United States Patent
Tominaga et al.

(10) Patent No.: US 8,524,434 B2
(45) Date of Patent: Sep. 3, 2013

(54) TONER AND METHOD FOR MANUFACTURING TONER

(75) Inventors: Tsuneyoshi Tominaga, Suntou-gun (JP); Ryoichi Fujita, Chofu (JP); Tsutomu Shimano, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 8 days.

(21) Appl. No.: 13/157,041

(22) Filed: Jun. 9, 2011

(65) Prior Publication Data

US 2011/0305984 A1 Dec. 15, 2011

(30) Foreign Application Priority Data

Jun. 11, 2010 (JP) ..... 2010-134312

(51) Int. Cl.
*G03G 9/00* (2006.01)

(52) U.S. Cl.
USPC ..... 430/110.2; 430/109.1; 430/109.4

(58) Field of Classification Search
USPC ..... 430/109.1, 109.4, 110.2
See application file for complete search history.

(56) References Cited

U.S. PATENT DOCUMENTS

2009/0035686 A1* 2/2009 Sacripante ..... 430/110.2
2009/0305159 A1* 12/2009 Zhou et al. ..... 430/110.2

FOREIGN PATENT DOCUMENTS

JP 2002-287426 A 10/2002
JP 2007-093809 A 4/2007

* cited by examiner

*Primary Examiner* — Mark F Huff
*Assistant Examiner* — Stewart Fraser
(74) *Attorney, Agent, or Firm* — Canon U.S.A., Inc., IP Division

(57) ABSTRACT

A toner having a toner particle including a core particle obtained by polymerizing a polymerizable monomer composition containing at least a polymerizable monomer, a colorant, a release agent, a polar resin, and a crystalline polyester in an aqueous medium and an outer shell formed by fixing resin fine particles to the surface of the core particle, wherein the resin constituting the resin fine particles is an amorphous resin and the acid value of the resin fine particles is 4.0 to 50.0 mgKOH/g.

8 Claims, 1 Drawing Sheet

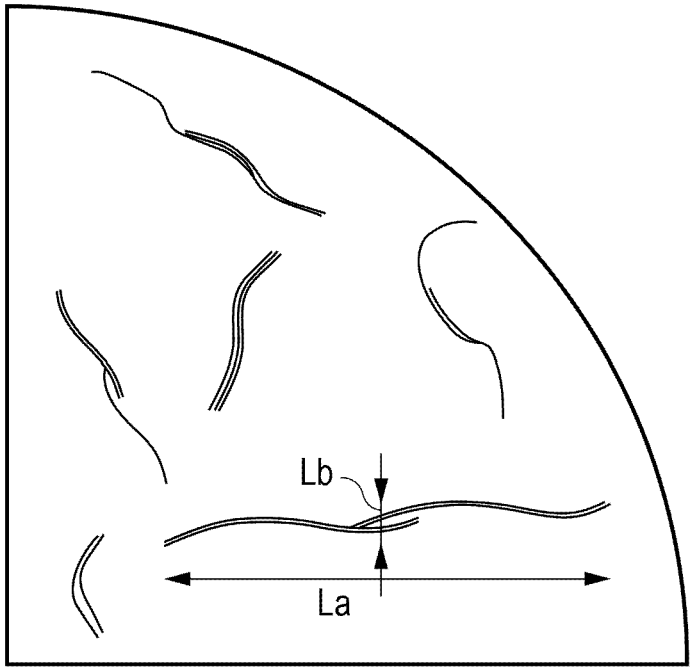
Lb
La

TONER AND METHOD FOR MANUFACTURING TONER

BACKGROUND OF THE INVENTION

1. Field of the Invention

The present invention relates to a toner used for developing an electrostatic latent image formed by a method, e.g., electrophotography, an electrostatic recording method, a magnetic recording method, and a toner jet system recording method, and a method for manufacturing a toner.

2. Description of the Related Art

A toner has been proposed, wherein a crystalline polyester having an excellent speed of response to heat, that is, having a sharp melt property, is added and, thereby, low-temperature fixing performance of the toner is improved.

Japanese Patent Laid-Open No. 2002-287426 has proposed a toner, wherein at least 90% of dispersed domains of crystalline polyester have diameters of 0.1 to 2 μm in order to obtain excellent low-temperature fixability.

Japanese Patent Laid-Open No. 2007-093809 has proposed a toner having a core layer containing an amorphous polyester and a crystalline polyester serving as binder resins and a shell layer covering the core layer in order to enhance the thermal storage resistance and the durability while the low-temperature fixing performance on the basis of a crystalline polyester is maintained.

The toner described in Japanese Patent Laid-Open No. 2002-287426 is produced by a pulverization method. Regarding such a toner, the crystalline polyester is exposed at a toner surface. As a result, the crystalline polyester serves as a leak site, sufficient triboelectric chargeability of the toner is not obtained. If the crystalline polyester is dispersed as in the toner described in Japanese Patent Laid-Open No. 2002-287426, the glass transition point of the toner is lowered because of a plasticizing effect of the crystalline polyester. Consequently, the thermal storage resistance of the toner is degraded.

Regarding the toner described in Japanese Patent Laid-Open No. 2007-093809, toner particles are produced by an aggregation method. Therefore, a crystalline polyester may be present in a cluster without being dispersed in a toner or the content of crystalline polyester per toner particle may become nonuniform. Consequently, regarding the durability, the toner may be cracked because of the crystalline polyester present in the shape of a domain, so that there is room for improvement in the thermal storage resistance. From the viewpoint of manufacturing method of the toner, it is difficult that the shell covers all over the surface of the core particle and, thereby, the core particle is exposed partly. As a result, the crystalline polyester is exposed at the toner surface, so that the charge stability of the toner is degraded.

SUMMARY OF THE INVENTION

As described above, regarding the toner having improved low-temperature fixing performance because of addition of the crystalline polyester, it is desired to ensure compatibility between the thermal storage resistance and the charge stability. Accordingly, aspects of the present invention are directed to providing a toner having improved low-temperature fixing performance because of addition of the crystalline polyester, the toner which can ensure compatibility between the thermal storage resistance and the charge stability to suppress fogging and degradation in image quality.

Aspects of the present invention provide a toner having a core particle including a binder resin, a colorant, a release agent, and a polar resin, wherein the whole surface of the core particle is covered with an amorphous outer shell and a crystalline polyester is dispersed finely in the core particle.

Furthermore, the aspects of the present invention provide a method for manufacturing a toner including the steps of polymerizing a polymerizable monomer composition containing a polymerizable monomer, a colorant, a release agent, and a polar resin in an aqueous medium so as to obtain a core particle and attaching resin fine particles to the surface of the core particle, wherein the polymerizable monomer composition contains a crystalline polyester, a resin constituting the resin fine particles is an amorphous resin, and the acid value of the resin fine particles is 4.0 to 50.0 mgKOH/g.

According to aspects of the present invention, regarding the toner having improved low-temperature fixing performance because of addition of the crystalline polyester, the toner which can ensure compatibility between the thermal storage resistance and the charge stability to suppress fogging and degradation in image quality can be provided.

Further features of the present invention will become apparent from the following description of exemplary embodiments with reference to the attached drawing.

BRIEF DESCRIPTION OF THE DRAWING

FIGURE is a schematic sectional view of a toner according to an embodiment of the present invention.

DESCRIPTION OF THE EMBODIMENTS

A toner containing a crystalline polyester has high low-temperature fixability. However, the mechanical strength of the crystalline polyester is low. Therefore, if the crystalline polyester is present in a cluster without being dispersed in a toner, cracking of the toner may occur. Meanwhile, regarding the toner according to aspects of the present invention, the crystalline polyester is dispersed finely in the core particle. In the case where the crystalline polyester is dispersed finely in the core particle, cracking of the toner resulting from the crystalline polyester can be prevented and, thereby, the thermal storage resistance of the toner is enhanced.

In aspects of the present invention, fine dispersion of the crystalline polyester is defined as described below. The definition of fine dispersion is that in observation of a cross-section of a toner subjected to ruthenium dyeing, the crystalline polyester is observed in such a way as to be in the state of a filament having a length La of 1,000 nm or less, a width Lb of 50 nm or less, the ratio La/Lb of the length La to the width Lb of 10 or more (refer to FIGURE). Regarding the dispersion state of the crystalline polyester in the toner, in one aspect, the length La is 800 nm or less, the width Lb is 50 nm or less, and the ratio La/Lb of the length La to the width Lb is 15 or more. As for other ranges, the length La is 600 nm or less, the width Lb is 40 nm or less, and the ratio La/Lb of the length La to the width Lb is 15 or more.

In the case where the crystalline polyester is exposed at the surface of the toner, the crystalline polyester serves as a leak site and, thereby, triboelectric chargeability of the toner is degraded. Furthermore, the glass transition point of the core particle may be lowered because of a plasticizing effect of the crystalline polyester, so that the toner may have insufficient thermal storage resistance. Therefore, regarding the toner according to aspects of the present invention, the whole surface of the core particle containing the crystalline polyester is covered with an amorphous outer shell. Such a configuration is employed and, thereby, even when the crystalline polyester is exposed at the surface of the core particle, leakage does not occur easily because of coverage with the amorphous outer shell. Moreover, since the whole surface of the core particle is covered with an outer shell, the toner can keep sufficient thermal storage resistance even when the glass transition point of the core particle is lowered because of the crystalline polyester contained.

In aspects of the present invention, the outer shell can be formed by attaching amorphous resin fine particles to the surface of the core particle. The outer shell of the toner is formed from such a resin and, thereby, the core particle including the crystalline polyester is covered, so that degradation in triboelectric chargeability of the toner due to leakage is prevented. Meanwhile, the outer shell formed from amorphous resin fine particles serves as a charge site and, therefore, the toner has sufficient triboelectric chargeability. Even in the case where the toner is charged excessively, an excess charge of the toner surface is relieved through the crystalline polyester, so that the charge stability of the toner is high. In addition, amorphous resin fine particles are elastic in general and are not cracked easily by pressure. Consequently, the durability of the toner can be enhanced.

A method for manufacturing a toner to obtain the above-described toner will be described. The present inventors found that the whole surface of a core particle was able to be covered with an outer shell by polymerizing a polymerizable monomer composition containing a polymerizable monomer, a colorant, a release agent, and a polar resin in an aqueous medium so as to form a core particle and attaching resin fine particles to the surface of the core particle. Furthermore, it was found that in the above-described method for manufacturing a toner, a core particle in which a crystalline polyester was finely dispersed was obtained by adding the crystalline polyester to the polymerizable monomer composition. It is believed that a core particle, in which a crystalline polyester is finely dispersed, is obtained in the case where the toner is produced by the above-described method because of the reasons described below. During polymerization of the polymerizable monomer, the crystal structure of the crystalline polyester is collapsed because of melting or dissolution and is converted to amorphous or liquid state, so that a part of the crystalline polyester becomes compatible with the polar resin. The polar resin tends to localize on the core particle surface as the polymerization of the polymerizable monomer proceeds in an aqueous medium. At this time, a part of the crystalline polyester mutually dissolved with the polar resin moves to the core particle surface. It is believed that the crystalline polyester is not gathered in one place, but is finely dispersed throughout the core particle including the surface of the core particle because of the function of the polar resin in the polymerizable monomer composition, as described above. Furthermore, the composition of the inside (excluding a surface layer) of the core particle has poor compatibility with the crystalline polyester and, therefore, the crystalline polyester present in the inside of the core particle keeps high crystallinity.

The presence of the crystalline polyester on the core particle surface facilitates attachment of resin fine particles to the core particle surface. As a result, the whole surface of the core particle can be covered with the outer shell resulting from the resin fine particles. The reason for this is believed to be that the abundance ratio of the polar resin on the core particle surface is decreased relatively because of the crystalline polyester, the polarity in the vicinity of the core particle surface is lowered and, thereby, electrical repulsion between the core particle and the resin fine particles is suppressed. In the case where the outer shell of the toner is formed by attaching resin fine particles to the surface of the core particle, when the toner is observed with TEM or the like, unevenness or the like resulting from the resin fine particles may be found. Observation of the state of such a toner surface can verify whether the outer shell of the toner is formed through attachment of resin fine particles to the surface of the core particle or not. In general, it is believed that in the case where the core particle is formed by the above-described suspension polymerization method, the core particle takes on the shape close to a sphere and, therefore, resin fine particles are easily uniformly attached.

The whole surface of the core particle can be covered with the resin fine particles by the method for manufacturing a toner, according to aspects of the present invention. Consequently, the crystalline polyester is not exposed at the toner surface and, thereby, durability and stable chargeability can be obtained. Furthermore, even in the case where the speed of a printer or a copier is increased and chances of contact of the toner with a developing member per unit time are increased, peeling of the resin fine particles from the core particle is prevented and contamination of the member due to cracking of the toner can also be prevented.

The above-described control of the toner structure is beyond what a method, e.g., a pulverization method, in which a toner composition is melt-mixed and is pulverized simply, can achieve. Regarding a method, e.g., an emulsion aggregation method, in which a fine particle dispersion liquid, such as, a resin particle dispersion liquid, is aggregated in an aqueous medium to obtain aggregated particles and fusing the aggregated particles to obtain an electrophotographic toner, variations occur in the dispersion states of individual fine particles with respect to the inside structure of each toner particle. Meanwhile, it is believed that in the case where the toner is produced by the suspension polymerization method as well, if the crystalline polyester is not present, not only the fixability is poor, but also a dense coating of resin fine particles is not obtained for the above-described reason and, thereby, desired structure control is not achieved.

The acid value of the resin fine particles used in aspects of the present invention may be 4.0 to 50.0 mgKOH/g, and even 7.0 to 40.0 mgKOH/g. In the case where the acid value of the resin fine particles is within the above-described range, the dispersibility of resin fine particles in the aqueous medium becomes favorable in production of the toner, and the resin fine particles in the form of aggregates are not fixed to the core particle surface, so that dense fixing can be achieved. Moreover, electrical repulsion between the resin fine particles and the core particle does not increase. Therefore, the core particle can be covered densely with the resin fine particles and peeling of the resin fine particles is prevented. The acid value of the resin fine particles can be controlled by the ratio of acid components of the resin constituting the resin fine particles, the type of the monomer, and an end group treatment of the resin constituting the resin fine particles. The method for measuring the acid value of the resin fine particles will be described later.

The acid value of the polar resin may be 5.0 to 30.0 mgKOH/g, and even 7.0 to 25.0 mgKOH/g. In the case where the acid value is within the above-described range, the polar resin is shifted to the core particle surface actively. The compatibility with the crystalline polyester and the granulation stability in the core particle formation become sufficient and, therefore, fixing of the resin fine particles can be performed more uniformly. As a result, peeling of the resin fine particles does not occur easily, the durability is improved, and furthermore, the thermal storage resistance is improved. The acid value of the polar resin can be controlled by the ratio of acid components of the polar resin, the type of the monomer, and an end group treatment of the resin constituting the resin fine particles. The method for measuring the acid value of the polar resin will be described later.

The content of the polar resin may be 1.0 to 30.0 percent by mass relative to the polymerizable monomer, and the content may even be 5.0 to 25.0 percent by mass. In the case where the content of the polar resin is within the above-described range, a layer of the polar resin is sufficiently formed on the core particle surface, the whole toner is excellent in elasticity, and the toner in itself is not cracked easily against a pressure, so that contamination of the member is prevented and excellent durability can be obtained.

The weight average molecular weight (Mw) of the polar resin on the basis of gel permeation chromatography (GPC) may be 3,000 to 60,000, such as 6,000 to 30,000 in terms of styrene. In the case where Mw of the polar resin is within the above-described range, the content and the state of presence of the polar resin in the individual toner particles become uniform. The method for measuring the weight average molecular weight (Mw) of the polar resin will be described later.

Examples of polar resins used in aspects of the present invention include copolymers of styrene and acrylic acid, copolymers of styrene and methacrylic acid, copolymers of styrene and unsaturated carboxylic acid ester or the like, polymers of nitrile based monomers, e.g., acrylonitrile, halogen-containing monomers, e.g., vinyl chloride, unsaturated carboxylic acids, e.g., acrylic acid and methacrylic acid, unsaturated dibasic acids and unsaturated dibasic acid anhydrides, and nitro based monomers, and the like or copolymers of these monomers and styrene based monomers, maleic acid copolymers, polyester resins, and epoxy resins.

Among them, the polar resin can be a styrene acrylic resin formed by using styrene and acrylic acid or methacrylic acid as copolymerization components in aspects of the present invention. In the case where the polar resin is a styrene acrylic resin, excessive mutual dissolution with the crystalline polyester is suppressed and the crystallinity of the crystalline polyester in the vicinity of the toner surface is maintained at a high level. A crystalline substance has a function of passing a charge to a greater extent as the crystallinity becomes higher, whereas amorphous resin fine particles present on the toner surface have an acid value and, therefore, deliver a charging function. As a result, when charging due to contact or friction occurs on the toner surface, an excess charge on the toner surface is passed by the crystalline polyester into the inside promptly, so that the chargeability becomes uniform among toners. Consequently, toner aggregation due to variations in chargeability is suppressed in the inside of a developing device, contact loads become uniform among toners, and the durability is improved.

The styrene acrylic resin can be formed by the following methods: (1) a solid phase polymerization method in which a monomer is polymerized in the state of including substantially no solvent, (2) a solution polymerization method in which all monomers, all polymerization initiators, and a solvent to be used in polymerization are added and the polymerization is effected in one operation, and (3) a dropping polymerization method in which polymerization is effected while monomer is added during a polymerization reaction. Furthermore, those produced by an atmospheric polymerization method and a pressure polymerization method can be used. Examples of copolymerization components used for forming the styrene acrylic resin include the following compounds: styrene; styrene based monomers, e.g., α-methyl styrene, o-methyl styrene, m-methyl styrene, p-methyl styrene, and p-methoxy styrene; acrylic acid esters, e.g., methyl acrylate, ethyl acrylate, n-butyl acrylate, isobutyl acrylate, and n-propyl acrylate; methacrylic acid esters, e.g., methyl methacrylate, ethyl methacrylate, n-propyl methacrylate, n-butyl methacrylate, and isobutyl methacrylate; acrylic acid or methacrylic acid derivatives, e.g., acrylonitrile, methacrylonitrile, and acrylamide; vinyl ethers, e.g., vinyl methyl ether, vinyl ethyl ether, and vinyl isobutyl ether; vinyl ketones, e.g., vinyl methyl ketone, vinyl hexyl ketone, and methyl isopropenyl ketone; N-vinyl compounds, e.g., N-vinyl pyrrole, N-vinyl carbazole, N-vinyl indole, and N-vinyl pyrrolidone; and vinyl naphthalenes.

In aspects of the present invention, the median diameter (D50) of the resin fine particles on a volume basis may be 10 nm or more, and 200 nm or less, such as 20 nm or more, and 130 nm or less. In the case where D50 of the resin fine particles is within the above-described range, in fixing of the resin fine particles to the core particle, the resin fine particles are not embedded excessively in the core particle and can be fixed to the core particle more uniformly and densely. In this regard, the median diameter refers to a particle diameter defined as a 50% value of an integral curve of particle size distribution (central integral value) and can be measured by using, for example, a laser diffraction/scattering particle size analysis system (LA-920) produced by Horiba, Ltd. The median diameter (D50) of the resin fine particles can be controlled by the properties of the resin constituting the resin fine particles, additives, and production conditions of the resin fine particles. Specific production conditions are not mentioned because various manufacturing methods are employed. As for the properties, control can be performed by the acid value of the resin constituting the resin fine particles, the type of a functional group, and the molecular weight. The method for measuring the median diameter (D50) on a volume basis of the resin fine particles will be described later.

In aspects of the present invention, the content of the crystalline polyester may be 2.0 to 30.0 percent by mass relative to the polymerizable monomer, and the content may even be 5.0 to 25.0 percent by mass. In the case where the content of the crystalline polyester is within the above-described range, the crystalline polyester is dispersed into the polar resin appropriately. Therefore, the resin fine particles can be fixed to the core particle surface densely. Furthermore, the crystalline polyester is sufficiently present in the inside of the toner, so that the low-temperature fixability is improved.

The melting point Tm1 (° C.) of the crystalline polyester may be 55.0° C. to 95.0° C., such as 60.0° C. to 90.0° C. In the case where Tm1 is within the above-described range, the crystalline polyester in the toner can keep the crystal state even in a high-temperature environment, and the crystalline polyester in the toner is melted promptly even at a low-temperature fixing condition. Consequently, the toner can obtain sufficient thermal storage resistance and excellent low-temperature fixing performance. The melting point of the crystalline polyester can be controlled by the types of the monomers, e.g., an alcohol component and an acid component, constituting the crystalline polyester. In this regard, the method for measuring the melting point of the crystalline polyester will be described later.

The amount of heat absorption Q (J/g) per unit weight of the crystalline polyester used in aspects of the present invention of an endothermic peak at the melting point Tm1 (° C.) may be 30.0 to 200.0 J/g, and even 80.0 to 150.0 J/g. In the case where the amount of heat absorption Q (J/g) is 30.0 to 200.0 J/g, the sharp melt property of the crystalline polyester can be fully used while heat absorption of the crystalline polyester is minimized. Consequently, excellent heat resistance and excellent fixability can be obtained. The amount of heat absorption Q (J/g) can be controlled by the ratio and the number of the monomers used for the crystalline polyester and the production condition in production of the crystalline polyester. The method for measuring the amount of heat absorption Q (J/g) will be described later.

In order to make full use of structure control in aspects of the present invention, the acid value of the crystalline polyester may be 1.0 mgKOH/g or more, and 50.0 mgKOH/g or less, and even 3.0 mgKOH/g or more, and 40.0 mgKOH/g or less. In the case where the acid value of the crystalline polyester is within the above-described range, the crystalline polyester in itself is shifted to the core particle surface easily. Therefore, the core particle surface can be covered with the resin fine particles more densely. Furthermore, in the fixing, mutual dissolution with the outer shell formed from the resin fine particles occurs promptly, plasticization is effected and, thereby, excellent low-temperature fixability can be obtained. The acid value of the crystalline polyester can be controlled by the ratio of an alcohol component to an acid component constituting the crystalline polyester, the type of the monomer, and an end group treatment of polyester. The method for measuring the acid value of the crystalline polyester will be described later.

Regarding the method for manufacturing a toner according to aspects of the present invention, in a step to polymerize the polymerizable monomer in the polymerizable monomer composition, the polymerization can be effected at a temperature higher than the melting point Tm1 (° C.) of the above-described crystalline polyester. In the case where the temperature higher than Tm1 is employed, the crystalline polyester and the polar resin become compatible with each other easily, so that the crystalline polyester moves to the surface layer of the core particle easily. The polymerization reaction is effected in that state and, thereby, the crystalline polyester can be finely dispersed into the core particle more reliably. Moreover, in a cooling step after completion of polymerization of the polymerizable monomer, the temperature lowering rate can be specified to be 0.1° C./min to 1.0° C./min and cooling to a temperature at least 10° C. lower than the glass transition temperature of the core particle can be performed. In the case where the cooling step is performed under the above-described condition, molten crystalline polyester can be recrystallized. Consequently, characteristics, e.g., low-temperature fixability, of the crystalline polyester are exerted favorably, so that the effect of the toner according to aspects of the present invention can be further enhanced.

Regarding the toner according to aspects of the present invention, the amount of coating with the outer shell formed from the resin fine particles may be 1.0 percent by mass or more, and 15.0 percent by mass or less on a mass ratio basis relative to the core particle. In the case where the amount of coating is within the above-described range, a dense coating layer can be formed without degrading the fixability of the toner. The amount of coating may be 2.0 percent by mass or more, and 10.0 percent by mass or less on a mass ratio basis relative to the core particle.

Regarding the toner according to aspects of the present invention, the weight average particle diameter (D4) is preferably 3.0 μm or more, and 9.0 μm or less, and the ratio (D4/D1) of D4 to the number average particle diameter (D1) may be 1.30 or less. The crystalline polyester can be incorporated in the toner sufficiently because D4 and D1 satisfy the above-described relationship, and even in the case where large amounts of crystalline polyester is added, the toner is not crushed easily and the durability is not degraded easily. Furthermore, the resin fine particles can be fixed to the core particle surface uniformly. According to one aspect, D4 is 4.0 μm or more, and 7.0 μm or less. Control of D4 and D4/D1 can be performed by the above-described acid values of the polar resin and the crystalline polyester and the production condition, e.g., the temperature and the amount of dispersion stabilizer, in production of the toner.

Next, a specific manufacturing method of the core particle by the suspension polymerization method will be described. Initially, a polymerizable monomer composition is prepared by adding at least a colorant, a release agent, a polar resin, and a crystalline polyester to a polymerizable monomer serving as a primary constituent material of the core particle and dissolving or dispersing them uniformly by using a dispersing machine, e.g., a homogenizer, a ball mill, a colloid mill, or an ultrasonic dispersing machine. At this time, as necessary, a polyfunctional monomer, a chain transfer agent, a charge control agent, a plasticizer, a release agent, and other additives (for example, a pigment dispersing agent and a release agent dispersing agent) can be added to the polymerizable monomer composition appropriately. Subsequently, the polymerizable monomer composition is put into an aqueous medium containing the dispersion stabilizer prepared in advance, and suspending and granulation are performed by using a high-speed dispersing machine, e.g., a high-speed agitator or an ultrasonic dispersing machine. The polymerization initiator may be mixed together with other additives in preparation of the polymerizable monomer composition or be mixed into the polymerizable monomer composition immediately before being suspended into the aqueous medium. Alternatively, the polymerization initiator in the state of being dissolved into the polymerizable monomer or other solvents, as necessary, can be added during granulation or after completion of granulation, that is, before the polymerization reaction is initiated. The polymerization reaction is effected by heating the suspension after granulation while agitation is performed in such a way that the particles of the polymerizable monomer composition in the suspension maintains the particle state and floating or settling of the particles does not occur and is completed, so as to form the core particle.

Examples of methods for attaching the resin fine particles to the surface of the core particle include a method in which the core particle and the resin fine particles are dry-mixed and attachment is performed by a mechanical treatment and a method in which the core particle and the resin fine particles are dispersed into the aqueous medium and heating, addition of a coagulant, or the like is performed. In aspects of the present invention, in order to attach the resin fine particles to the core particle surface uniformly and densely, the resin fine particles can be fixed to the core particle surface by being heated in the aqueous medium. In particular, the resin fine particles can be attached by the following method.

The core particle is produced by the suspension polymerization method following the above-described method. As for the dispersion stabilizer at this time, for example, an inorganic dispersing agent, e.g., tricalcium phosphate, is used where the polarity with respect to the core particle and the polarity with respect to the resin fine particles are different to a great extent. After the polymerization is completed, the dispersion stabilizer attached to the core particle surface is not removed and agitation is continued as-is. Then, an aqueous dispersion of amorphous resin fine particles having an acid value is added to the dispersion liquid of the core particle in the state of having dispersion stabilizer attached. The resin fine particles can have a glass transition temperature higher than that of the core particle. In this manner, the resin fine particles are attached to the surface of the core particle with the dispersion stabilizer therebetween. At this time, the crystalline polyester is dispersed in the polar resin in the vicinity of the core particle surface, so that the polarity is suppressed in the portion in which the dispersion stabilizer is not present and the resin fine particles can be attached to the whole surface of the core particle while electric repulsion of the resin fine particles does not occur.

Subsequently, the resulting dispersion liquid is heated up to the glass transition temperature of the above-described core particle or higher. The temperature of the dispersion liquid is kept within the temperature range of the glass transition temperature of the above-described core particle to the glass transition temperature of the above-described resin fine particles and an acid is added to the suspension slowly to dissolve the above-described dispersion stabilizer gradually. When the dispersion stabilizer is removed, as described above, the resin fine particles come into contact with the surface of the core particle at the same time, so as to be fixed (adhered) while the uniform state is maintained.

In particular, after the above-described addition of the acid, an alkali is added to the resulting dispersion liquid to adjust the pH to come into the range in which the inorganic dispersing agent concerned is reprecipitated and, then, heating can be performed at the glass transition temperature of the above-described resin fine particles or higher. The surface of the particle having the resin fine particles adhered is covered with the inorganic dispersing agent by reprecipitating the inorganic dispersing agent through adjustment of pH. Therefore, even when heating to the glass transition temperature of the resin fine particles or higher is performed, aggregation of the particles with each other can be suppressed. Consequently, the outer shell formed from the resin fine particles is smoothed and a more uniform denser layer results.

The crystalline polyester can be obtained by a reaction between a polyvalent carboxylic acid having at least divalent and a diol. Among them, polyesters containing aliphatic diol and aliphatic dicarboxylic acid as primary components can be employed because of a high degree of crystallinity. Examples of alcohol monomers to obtain such a crystalline polyester include ethylene glycol, diethylene glycol, 1,2-propylene glycol, 1,3-propylene glycol, and 1,4-butane diol. In aspects of the present invention, the above-described alcohol monomers are used as primary components, although besides the above-described components, polyoxyethylenated bisphenol A, polyoxypropylenated bisphenol A, dihydric alcohols, e.g., 1,4-cyclohexane dimethanol, aromatic alcohols, e.g., 1,3,5-trihydroxymethylbenzene, and trihydric alcohols, e.g., pentaerithritol, and the like may be used.

Examples of carboxylic acid monomers to obtain the crystalline polyester include dicarboxylic acids, e.g., succinic acid, adipic acid, oxalic acid, sebacic acid, and decanedicarboxylic acid, and anhydrides or lower alkyl esters of these acids. In aspects of the present invention, the above-described carboxylic acids are used as primary components, but besides the above-described components, polyvalent carboxylic acids having at least trivalent, e.g., trimellitic acid, 2,5,7-naphthalenetricarboxylic acid, 1,2,4-naphthalenetricarboxylic acid, pyromellitic acid, 1,2,4-butanetricarboxylic acid, 1,2,5-hexanetricarboxylic acid, and 1,3-dicarboxyl-2-methyl-2-methylenecarboxypropane, and derivatives, e.g., anhydrides or lower alkyl esters, thereof may be used.

The crystalline polyester is obtained by adjusting the types and the copolymerization ratio of monomers used and effecting polymerization on the basis of the known methods. For example, the crystalline polyester is obtained by subjecting a dicarboxylic acid component and a dialcohol component to an esterification reaction or transesterification reaction and, thereafter, subjecting to a polycondensation reaction under reduced pressure or introduction of a nitrogen gas. In the esterification reaction or the transesterification reaction, a common esterification catalyst or transesterification catalyst, such as, sulfuric acid, titanium butoxide, dibutyltin oxide, manganese acetate, and tetrabutyl titanate, can be used, as necessary. Regarding the polymerization, common known polymerization catalysts, such as, titanium butoxide, dibutyltin oxide, tin acetate, zinc acetate, tin disulfide, antimony trioxide, and germanium dioxide, can be used. The polymerization temperature and the amount of catalyst are not specifically limited and may be selected appropriately, as necessary.

Furthermore, the acid value of the crystalline polyester can be controlled by end-capping a carboxyl group at a polymer end. As for end-capping, a monocarboxylic acid or a monoalcohol can be used. Examples of monocarboxylic acids include benzoic acid, naphthalenecarboxylic acid, salicylic acid, 4-methyl benzoic acid, 3-methyl benzoic acid, phenoxyacetate, biphenylcarboxylic acid, acetic acid, propionic acid, butyric acid, octanoic acid, decanoic acid, dodecanoic acid, and stearic acid. As for a monoalcohol, methanol, ethanol, propanol, isopropanol, butanol, and higher alcohols can be used.

As for the amorphous polyester serving as the polar resin, those produced by polycondensating the above-described alcohol components and the acid components by known methods can be used.

As for a method for manufacturing the resin fine particles according to aspects of the present invention, known methods can be used. Specifically, the resin fine particles produced by methods, such as, the emulsion polymerization method, a soap-free emulsion polymerization method, and a phase inversion emulsion polymerization method, can be used. Among these manufacturing methods, in particular, the phase inversion emulsion polymerization method can be employed because resin fine particles having small particle diameters and a narrow particle size distribution are obtained easily.

The method for manufacturing a resin fine particle dispersion liquid on the basis of the phase inversion emulsion polymerization method will be described specifically. A resin, which has predetermined properties and which has been produced in advance, is dissolved into an organic solvent capable of dissolving the resin, a surfactant and a neutralizer are added, as necessary, and the resulting solution is mixed with an aqueous medium while agitation is performed. Consequently, phase inversion emulsification of the solution of the above-described resin occurs so as to form fine particles. The organic solvent concerned is removed by a method, e.g., heating or reduction of pressure, after the phase inversion emulsification. In this manner, a stable aqueous dispersion of resin fine particles having small particle diameters and a narrow particle size distribution can be obtained. As for the material for the resin fine particles, any resin which can be used as a toner binder resin, can be employed, and resins, e.g., vinyl based resins, polyester resins, epoxy resins, and urethane resins can be used. Among them, polyester resins can be used because of a sharp melt property and a small extent of inhibition of the low-temperature fixability of the core particle.

Examples of polymerizable monomers used as the material for the binder resin contained in the core particle include the following: styrene; styrene based monomers, e.g., α-methyl styrene, o-methyl styrene, m-methyl styrene, p-methyl styrene, and p-methoxy styrene; acrylic acid esters, e.g., methyl acrylate, ethyl acrylate, n-butyl acrylate, isobutyl acrylate, and n-propyl acrylate; methacrylic acid esters, e.g., methyl methacrylate, ethyl methacrylate, n-propyl methacrylate, n-butyl methacrylate, and isobutyl methacrylate; acrylonitrile, methacrylonitrile, and acrylamide. Among these polymerizable monomers, styrene and acrylic polymerizable monomers can be used in combination and the binder resin can be specified to be styrene acryl copolymers. In the case where a toner is formed by using styrene and acrylic polymerizable monomers and using styrene acrylic resins as the polar resin on the basis of the suspension polymerization method, regarding the internal structure of the toner, a gentle gradient structure is formed, wherein the abundance of the styrene acrylic resin increases toward the core particle surface. Consequently, even if a brittle crystalline polyester is present, the durability of the whole toner is kept constant, and contamination of a member due to cracking of the toner is suppressed. The mixing ratio of these polymerizable monomers is selected appropriately in consideration of the predetermined glass transition point of the core particle.

In production of the above-described core particle, a small amount of polyfunctional monomer can be used in combination for the purpose of improving the high-temperature offset resistance. In this regard, the high-temperature offset refers to a phenomenon in which a part of the toner melted in fixing is attached to the surface of a hot roller or a fixing film, and this contaminates the following fixing receiving sheet. As for the polyfunctional monomer, compounds having at least two polymerizable double bonds are used mainly. Examples thereof include aromatic divinyl compounds, e.g., divinylbenzene and divinylnaphthalene; carboxylic acid esters having two double bonds; e.g., ethylene glycol diacrylate, ethylene glycol dimethacrylate, and 1,3-butane diol dimethacrylate; divinyl compounds, e.g., divinylaniline, divinyl ether, divinyl sulfide, and divinyl sulfone; and compounds having at least three vinyl groups. These polyfunctional monomers are not necessarily used. In the case where they are used, the amount of addition may be 0.01 parts by mass or more, and 1.00 part by mass or less relative to 100.00 parts by mass of polymerizable monomer.

In production of the above-described core particle, as for the dispersion stabilizer added to the aqueous medium, known surfactants, organic dispersing agents, and inorganic dispersing agents can be used. Among them, the inorganic dispersing agents can be used because an ultrafine powder is not generated easily, the stability is not degraded easily even when the polymerization temperature is changed, and cleaning is performed easily without exerting adverse influence on the toner easily. Examples of such inorganic dispersing agents include the following: phosphoric acid polyvalent metal salts, e.g., tricalcium phosphate, magnesium phosphate, aluminum phosphate, and zinc phosphate; carbonates, e.g., calcium carbonate and magnesium carbonate; inorganic salts, e.g., calcium metasilicate, calcium sulfate, and barium sulfate; and inorganic oxides, e.g., calcium hydroxide, magnesium hydroxide, aluminum hydroxide, silica, bentonite, and alumina. In the case where these inorganic dispersing agent is used, the agent may be added as-is to the aqueous medium. However, in order to obtain finer particles, a compound capable of generating inorganic dispersing agent particles is used and, thereby, an inorganic dispersing agent can be prepared in an aqueous medium and be used. For example, regarding tricalcium phosphate, water-insoluble tricalcium phosphate can be generated by mixing a sodium phosphate aqueous solution and a calcium chloride aqueous solution under high-speed agitation, wherein more uniform, finer dispersion can be ensured. After the polymerization is finished, these inorganic dispersing agents can be almost completely removed by adding an acid or an alkali so as to dissolve. It may be that 0.2 parts by mass or more, and 20.0 parts by mass or less of these inorganic dispersing agents are used alone relative to 100.0 parts by mass of polymerizable monomer. However, as necessary, 0.001 parts by mass or more, and 0.100 parts by mass or less of surfactant may be used in combination. Examples of surfactants include the following: sodium dodecylbenzenesulfate, sodium tetradecylsulfate, sodium pentadecylsulfate, sodium octylsulfate, sodium oleate, sodium laurate, sodium stearate, and potassium stearate.

In production of the above-described core particle, a chain transfer agent can be used for the purpose of adjusting the molecular weight. Examples of chain transfer agents include the following: alkyl mercaptans, e.g., n-pentyl mercaptan, isopentyl mercaptan, 2-methylbutyl mercaptan, n-hexyl mercaptan, and n-heptyl mercaptan; alkyl esters of thioglycolic acid; alkyl esters of mercaptopropionic acid; and α-methylstyrene dimer. These chain transfer agents are not necessarily used. In the case where they are used, the amount of addition may be 0.05 parts by mass or more, and 3.00 parts by mass or less relative to 100.00 parts by mass of polymerizable monomer.

Examples of release agent used for the toner according to aspects of the present invention include the following: petroleum wax, e.g., paraffin wax, microcrystalline wax, and petrolatum, and derivatives thereof; montan wax and derivatives thereof; hydrocarbon wax on the basis of a Fischer-Tropsch method and derivatives thereof; polyolefin wax typified by polyethylene and derivatives thereof; and natural wax, e.g., carnauba wax and candelilla wax, and derivatives thereof. The derivatives include block copolymers with oxides and vinyl based monomers and graft-modified products. Furthermore, higher fatty alcohols, aliphatic acids, e.g., stearic acid and palmitic acid, or compounds thereof, acid amide wax, ester wax, ketone, plant based wax, and animal wax can also be used. Among these release agent, in particular, paraffin wax can be used because of being incorporated into the core particle more easily. The amount of addition of the release agent may be 3.0 parts by mass or more, and 30.0 parts by mass or less relative to 100.00 parts by mass of polymerizable monomer.

As for the colorant used for the toner according to aspects of the present invention, known colorants can be used. Examples thereof include carbon black and magnetic powders serving as black colorants and yellow/magenta/cyan colorants described below. Examples of yellow colorants include the following: condensed azo compounds, isoindolinone compounds, anthraquinone compounds, azo metal complexes, methine compounds, and allylamide compounds. Specifically, C.I. Pigment Yellow 12, 13, 14, 15, 62, 73, 74, 83, 93, 94, 95, 109, 110, 111, 128, 129, 147, 155, 168, 180, and 185 can be used. Examples of magenta colorants include the following: condensed azo compounds, diketopyrrolopyrrole compounds, anthraquinone, quinacridone compounds, basic dye lake compounds, naphthol compounds, benzimidazolone compounds, thioindigo compounds, and perylene compounds. Specifically, C.I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254, and 269 can be used. Examples of cyan colorants include the following: copper phthalocyanine compounds and derivatives thereof, anthraquinone compounds, and basic dye lake compounds. Specifically, C.I. Pigment Blue 1, 7, 15, 15:1, 15:2, 15:3, 15:4, 60, 62, and 66 can be used.

These colorants can be used alone, in combination, or in the state of solid solution. In the case where the magnetic powder is used as the black colorant, the amount of addition thereof may be 40.0 parts by mass or more, and 150.0 parts by mass or less relative to 100.00 parts by mass of polymerizable monomer. In the case where the carbon black is used as the black colorant, the amount of addition thereof may be 1.0 part by mass or more, and 20.0 parts by mass or less relative to 100.00 parts by mass of polymerizable monomer. In the case of a color toner, the colorant is selected from the viewpoint of the hue angle, the saturation, the brightness, the weather resistance, the OHP transparency, and dispersibility into the toner, and the amount of addition thereof may be 1.0 part by mass or more, and 20.0 parts by mass or less relative to 100.00 parts by mass of polymerizable monomer. It is necessary to note the polymerization inhibiting property and the property to migrate to a water phase of these colorants, and as necessary, a surface treatment, e.g., a hydrophobic treatment, can be performed. Examples of methods for surface-treating a dye based colorant can include a method in which the polymerizable monomer is polymerized in the presence of a dye in advance, and the resulting colored polymer is added to the polymerizable monomer composition. Regarding the carbon black, besides the same treatment as that for the above-described dye, a graft treatment with a substance, e.g., polyorganosiloxane, which reacts with a surface functional group of the carbon black, may be performed. Meanwhile, the magnetic powder contains iron oxide, e.g., triiron tetroxide or γ-ferric oxide, as a primary component and has hydrophilicity in general. Therefore, the magnetic powder tends to localize on the particle surface because of interaction with water serving as a dispersion medium. Consequently, the resulting toner exhibits poor fluidity and uniformity in triboelectric charging because of the magnetic powder exposed at the surface. Then, the surface of the magnetic powder can be subjected to a uniform hydrophobic treatment with a coupling agent. Examples of usable coupling agents include silane coupling agents and titanium coupling agents. In particular, the silane coupling agent can be used.

The polymerization initiator used in production of the above-described core particle is not specifically limited, and known peroxide based polymerization initiators and azo based polymerization initiators can be used. Examples of peroxide based polymerization initiators include the following: peroxyester based polymerization initiators, e.g., t-butyl peroxylaurate, t-butyl peroxyneodecanoate, t-butyl peroxypivalate, t-butyl peroxy-2-ethylhexanoate, and t-butyl peroxyisobutyrate; peroxydicarbonate based polymerization initiators, e.g., di-n-propyl peroxydicarbonate, di-n-butyl peroxydicarbonate, and di-n-pentyl peroxydicarbonate; diacyl peroxide based polymerization initiators, e.g., diisobutyryl peroxide, diisononanoyl peroxide, and di-n-octanoyl peroxide; peroxy monocarbonate based polymerization initiators, e.g., t-hexyl peroxyisopropylmonocarbonate, t-butyl peroxyisopropylmonocarbonate, and t-butyl peroxy-2-ethylhexylmonocarbonate; and dialkyl peroxide based polymerization initiators, e.g., dicumyl peroxide, di-t-butyl peroxide, and t-butylcumyl peroxide.

Examples of azo based polymerization initiators include the following: 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile. Among these polymerization initiators, peroxide based polymerization initiators can be favorably used because large amounts of decomposition products do not remain. Furthermore, at least two types of these polymerization initiators can be used at the same time, as necessary. At this time, the usage of the polymerization initiator may be 0.1 parts by mass or more, and 20.0 parts by mass or less relative to 100.00 parts by mass of polymerizable monomer.

The toner according to aspects of the present invention can contain, as necessary, a charge control agent for the purpose of stabilizing the charge characteristics. As for the method for containing the agent, a method in which the agent is added to the inside of the toner and a method in which the agent is added externally are mentioned. As for the charge control agent, known agents can be used. In the case of addition to the inside, in particular, a charge control agent having a poor polymerization inhibiting property and containing substantially no material soluble into the aqueous dispersion medium can be employed. Specific examples of the compounds serving as a negative charge control agent include the following: metal compounds of aromatic carboxylic acid, e.g., salicylic acid, alkyl salicylic acid, dialkyl salicylic acid, naphthoic acid, and dicarboxylic acid; metal salts or metal complexes of azo dyes or azo pigments; polymer type compounds having a sulfonic acid or carboxyl acid group in a side chain; boron compounds, urea compounds, silicon compounds, and calixarenes. Examples of positive charge control agents include quaternary ammonium salts, polymer type compounds having the quaternary ammonium salt in a side chain, guanidine compounds, and imidazole compounds.

The usage of these charge control agents is determined on the basis of the type of the binder resin, presence or absence of other additives, and the toner manufacturing method including the dispersion method. Therefore, the usage is not limited univocally. As for the internal addition, the usage may be within the range of 0.1 parts by mass or more, and 10.0 parts by mass or less, such as 0.1 parts by mass or more, and 5.0 parts by mass or less relative to 100.00 parts by mass of binder resin. As for the external addition, the usage may be 0.005 to 1.000 part by mass, and even 0.010 to 0.300 parts by mass relative to 100.000 parts by mass of toner.

Regarding the toner according to aspects of the present invention, an inorganic fine powder serving as a fluidity improver can be mixed into the toner through external addition. The inorganic fine powder can be hydrophobic. For example, a titanium oxide fine powder, a silica fine powder, or an alumina fine powder can be added and used, and in particular, the silica fine powder can be used. The inorganic fine powder used in aspects of the present invention can have a specific surface area on the basis of nitrogen adsorption measured by a BET method of 30 $m^2/g$ or more, and particularly within the range of 50 to 400 $m^2/g$ because a favorable result can be obtained.

The toner according to aspects of the present invention may contain external additives other tan the above-described fluidity improver, as necessary. For example, for the purpose of improving the cleanability, a form can be employed, in which fine particles having a primary particle diameter exceeding 30 nm, in particular inorganic fine particles or organic fine particles having a primary particle diameter of 50 nm or more and having a nearly spherical shape are further added to the toner. For example, spherical silica particles, spherical polymethylsilsesquioxane particles, and spherical resin fine particles can be used. Furthermore, a small amount of other additives, for example, lubricant powders, e.g., a fluorine resin powder, a zinc stearate powder, and a polyvinylidene fluoride powder; abrasives, e.g., a cerium oxide powder, a silicon carbide powder, a strontium titanate powder; a caking inhibitor; electrical conductivity imparting agents, e.g., a carbon black powder, a zinc oxide powder, and a tin oxide powder; an antipolar organic fine particles, and inorganic fine particles can be added as a developability improver. These additives can also be used after the surfaces thereof are subjected to a hydrophobic treatment. The usage of the above-described external additives can be 0.1 to 5.0 parts by mass (such as 0.1 to 3.0 parts by mass) relative to 100.0 parts by mass of toner.

The toner according to aspects of the present invention can be used as a one-component developer as-is or as a two-component developer after being mixed with a magnetic carrier. As for the use as the two-component developer, the average particle diameter of the carrier to be mixed may be 10 to 100 μm, and the toner concentration in the developer may be 2 to 15 percent by mass.

Measurement of Length La and Width Lb of Crystalline Polyester and State of Coverage with Outer Shell After the toner is dispersed sufficiently in an epoxy resin curable at ambient temperature, curing is performed in an atmosphere at a temperature of 40° C. for 2 days. The resulting cured product is cut by using a microtome provided with a diamond tooth so as to produce a slice-shaped sample. As necessary, dyeing is performed by using triruthenium tetroxide and, thereafter, the state of a cross-section of the toner is observed by using a transmission electron microscope (TEM). In the above-described observation method, an amorphous portion of the toner is intensely dyed with triruthenium tetroxide. As a result, amorphous portions, e.g., the binder resin and the amorphous polyester, are dyed, and crystalline polyester portions, which are not dyed, can be observed as contrasts. The magnification in the observation is specified to be 20,000 times. The image resulting from the above-described photographing is read at 600 dpi through an interface and is introduced into an image analyzer WinROOF Version 5.0 (produced by Microsoft-MITANI CORPORATION). The length La' and the width Lb' of every filament-shaped substance (crystalline polyester) observed in the toner cross-section are measured. This measurement is performed with respect to arbitrary 50 toner cross-sections. The arithmetic average of each of the resulting La' and Lb' is determined and the length La and the width Lb of the crystalline polyester in the toner are calculated. In this regard, all filament-shaped crystalline polyesters observed by the above-described method are not observed as straight lines, but a part of them may be observed as curved lines. In this case, the length La' is assumed to be the distance between two ends where the curved crystalline polyester is made into the state of a straight line. The observed width Lb' of the crystalline polyester is assumed to be the width of the thickest portion of each crystalline polyester.

Regarding the toner cross-section obtained as described above, observation of the unevenness resulting from resin fine particles on the toner surface can verify whether the outer shell of the toner is formed through attachment of the resin fine particles to the surface of the core particle or not.

Acid Values of Crystalline Polyester, Polar Resin, and Resin Constituting Resin Fine Particles The acid values of the crystalline polyester, the polar resin, and the resin constituting the resin fine particles are measured on the basis of JIS K1557-1970. A specific measuring method will be described below. A sample is pulverized and 2 g thereof is precisely weighed (W (g)). The sample is put into a 200 ml Erlenmeyer flask, 100 ml of mixed solution of toluene/ethanol (2:1) is added, and dissolution is performed for 5 hours. A phenolphthalein solution is added as an indicator. The above-described solution is titrated with a buret by using a 0.1 N KOH alcohol solution. The amount of the KOH solution at this time is assumed to be S (ml). A blank test is performed, and the amount of the KOH solution at this time is assumed to be B (ml). The acid value is calculated on the basis of the following formula.

$$\text{acid value}=[(S-B)\times f\times 5.61]/W$$

(f: a factor of KOH solution)

In the case where the acid value of a sulfonic acid group is determined, quantitative analysis of S element is performed by using, for example, an X-ray fluorescence analyzer (XRF), and the amount of functional group equivalent in terms of potassium hydroxide contained in 1 g of resin is determined.

D50 on a Volume Basis of Resin Fine Particles

The median diameter (D50) on a volume basis of the resin fine particles is measured by using a laser diffraction/scattering particle size analysis system. Specifically, the measurement is performed on the basis of JIS Z8825-1 (2001). As for the measuring apparatus, a laser diffraction/scattering particle size analysis system "LA-920" (produced by Horiba, Ltd.) is used. As for setting of the measurement condition and analysis of the measurement data, dedicated software "HORIBA LA-920 for Windows (registered trademark) WET (LA-920) Ver. 2.02" attached to LA-920 is used. As for a measurement solvent, ion-exchanged water, from which impurity solids and the like have been removed in advance, is used. The measurement procedure is as described below.

(1) A batch type cell holder is attached to LA-920.
(2) A predetermined amount of ion-exchanged water is put into a batch type cell, and the batch type cell is set into a batch type cell holder.
(3) The inside of the batch type cell is agitated by using a dedicated stirrer tip.
(4) The relative refractive index is set at 1.20 by pushing a "Refractive index" button on a "Display condition setting" screen.
(5) The reference of particle diameter is set at "On a volume basis" on the "Display condition setting" screen.
(6) After warming-up is performed for at least 1 hour, adjustment of an optical axis, fine adjustment of the optical axis, and a blank measurement are performed.
(7) A 100 ml glass flat-bottom beaker is charged with 3 ml of resin fine particle dispersion liquid. Furthermore, 57 ml of ion-exchanged water is put in so as to dilute the resin fine particle dispersion liquid. Then, 0.3 ml of diluent is added thereto as a dispersing agent, the diluent being prepared by diluting "Contaminon N" (a 10 percent by mass aqueous solution of neutral detergent for washing a precision measuring device, including a nonionic surfactant, an anionic surfactant, and an organic builder and exhibiting pH 7, produced by Wako Pure Chemical Industries, Ltd.) with ion-exchanged water by a factor of 3 on a mass basis.
(8) An ultrasonic dispersion system "Ultrasonic Dispersion System Tetora 150" (produced by Nikkaki-Bios Co., Ltd.) is prepared, the system incorporating two oscillators with an oscillation frequency of 50 kHz in such a way that the phases are displaced by 180° and having an electric output of 120 W. Then, 3.3 l of ion-exchanged water is put into a water tank of the ultrasonic dispersion system, and 2 ml of Contaminon N is added to the inside of this water tank.
(9) The beaker in the above-described item (7) is set in a beaker fixing hole of the above-described ultrasonic dispersion system, and the ultrasonic dispersion system is actuated. The height position of the beaker is adjusted in such a way that the resonance state of the liquid surface of the aqueous solution in the beaker is maximized.
(10) The ultrasonic dispersion treatment is continued for 60 seconds. In the ultrasonic dispersion, the water temperature of the water tank is controlled at 10° C. or higher, and 40° C. or lower appropriately.
(11) The resin fine particle dispersion liquid prepared in the above-described item (10) is added immediately to the batch type cell little by little with attention to prevent air bubbles from being included, so that the transmittance of a tungsten lamp is adjusted to become 90% to 95%. Subsequently, the particle size distribution is measured. The D50 is calculated on the basis of the data of the resulting particle size distribution on a volume basis.

Weight Average Molecular Weight of Polar Resin

The weight average molecular weight of the polar resin is measured by gel permeation chromatography (GPC) in a manner as described below. Initially, a sample is dissolved into tetrahydrofuran (THF) at room temperature over 24 hours. Subsequently, the resulting solution is filtrated with a solvent-resistant membrane filter "Maishori Disk" (produced by Tosoh Corporation) having a pore diameter of 0.2 μm, so as to obtain a sample solution. The sample solution is adjusted in such a way that the concentration of a component soluble into THF becomes 0.8 percent by mass. This sample is used, and the measurement is performed under the following condition.

Apparatus: HLC8120 GPC (detector: RI) (produced by Tosoh Corporation)

Column: Shodex seven-gang of KF-801, 802, 803, 804, 805, 806, and 807 (produced by SHOWA DENKO K.K.)

Eluting solution: tetrahydrofuran (THF)

Flow rate: 1.0 ml/min

Oven temperature: 40.0° C.

Amount of sample injection: 0.10 ml

In calculation of the molecular weight of the sample, a molecular weight calibration curve formed by using standard polystyrene resins (for example, trade name "TSK Standard Polystyrene F-850, F-450, F-288, F-128, F-80, F-40, F-20, F-10, F-4, F-2, F-1, A-5000, A-2500, A-1000, and A-500", produced by Tosoh Corporation) are used.

Glass Transition Temperature of Toner, Glass Transition Temperature of Core Particle, Glass Transition Temperature of Resin Fine Particles, and Melting Point (Tm1) and Amount of Heat Absorption of Crystalline Polyester The glass transition temperature of the toner, the glass transition temperature of the core particle, the glass transition temperature of the resin fine particles, and the melting point and the amount of heat absorption of the crystalline polyester are measured by using a differential scanning calorimeter "Q1000" (produced by TA Instrument) on the basis of ASTM D3418-82. The melting points of indium and zinc are used for the temperature correction of the detection portion of the apparatus and the heat of fusion of indium is used for the correction of the amount of heat. Specifically, 5 mg of toner, 5 mg of core particle, and 5 mg of resin constituting the resin fine particles or 1 mg of crystalline polyester are weighed precisely and are put into an aluminum pan. An empty aluminum pan is used as a reference, and a modulation measurement is performed in a measurement range of 20° C. to 140° C. at settings of a temperature raising rate of 1° C./min and a width of amplitude of temperature of ±0.318° C. In this temperature raising process, a changes in specific heat is obtained in the temperature range of 20° C. to 140° C. The glass transition temperatures Tg of the toner, the core particle, and the resin fine particles are assumed to be the point of intersection of a line intermediate between base lines before and after the appearance of the change in specific heat of the curve of reversible specific heat change and the differential thermal curve. Meanwhile, the melting point (Tm1) and the amount of heat absorption of the crystalline polyester are assumed to be the maximum endothermic peak temperature of the curve of specific heat change and the amount of heat absorption at the endothermic peak, respectively.

Particle Size Distribution of Toner

The weight average particle diameter (D4) and the number average particle diameter (D1) of the toner are calculated as described below. As for the measuring apparatus, a precise particle size distribution measurement apparatus "Coulter Counter Multisizer 3" (registered trademark, produced by Beckman Coulter, Inc.) equipped with a 100 μm aperture tube on the basis of a pore electrical resistance method is used. Regarding setting of the measurement conditions and analysis of the measurement data, an attached dedicated software "Beckman Coulter Multisizer 3 Version 3.51" (produced by Beckman Coulter, Inc.) is used. In this regard, the measurement is performed with the number of effective measurement channels of 25,000 channels.

As for the electrolytic aqueous solution used for the measurement, a solution prepared by dissolving special grade sodium chloride into ion-exchanged water in such a way as to have a concentration of about 1 percent by mass, for example, "ISOTON II" (produced by Beckman Coulter, Inc.), can be used.

By the way, prior to the measurement and the analysis, the above-described dedicated software is set as described below.

In the screen of "Modification of the standard operating method (SOM)" of the above-described dedicated software, the total count number in the control mode is set at 50,000 particles, the number of measurements is set at 1 time, and the Kd value is set at a value obtained by using "Standard particles 10.0 μm" (produced by Beckman Coulter, Inc.). The threshold value and the noise level are automatically set by pressing "Threshold value/noise level measurement button". In addition, the current is set at 1,600 μA, the gain is set at 2, the electrolytic solution is set at ISOTON II, and a check is entered in "Post-measurement aperture tube flush".

In the screen of "Setting of conversion from pulses to particle diameter" of the above-described dedicated software, the bin interval is set at logarithmic particle diameter, the particle diameter bin is set at 256 particle diameter bins, and the particle diameter range is set at 2 μm to 60 μm.

The specific measurement procedure is as described below.

(1) A 250 ml round-bottom glass beaker dedicated to Multisizer 3 is charged with 200 ml of the above-described electrolytic aqueous solution, the beaker is set in a sample stand, and counterclockwise agitation is performed with a stirrer rod at 24 revolutions/sec. Then, contamination and air bubbles in the aperture tube are removed by "Aperture flush" function of the dedicated software.

(2) A 100 ml flat-bottom glass beaker is charged with 30 ml of the above-described electrolytic aqueous solution. A diluted solution is prepared by diluting "Contaminon N" (a 10 percent by mass aqueous solution of neutral detergent for washing a precision measuring device, including a nonionic surfactant, an anionic surfactant, and an organic builder and having a pH of 7, produced by Wako Pure Chemical Industries, Ltd.) with ion-exchanged water by a factor of 3 on a mass basis and 0.3 ml of the diluted solution serving as a dispersing agent is added to the inside of the beaker.

(3) An ultrasonic dispersing machine "Ultrasonic Dispersion System Tetora 150" (produced by Nikkaki Bios Co., Ltd.) is prepared, the system incorporating two oscillators with an oscillatory frequency of 50 kHz in such a way that the phases are displaced by 180 degrees and having an electrical output of 120 W. Then, 3.3 l of ion-exchanged water is put into a water tank of the ultrasonic dispersion system, and 2 ml of Contaminon N is added to the inside of this water tank.

(4) The beaker in the above-described item (2) is set in a beaker fixing hole of the above-described ultrasonic dispersion system, and the ultrasonic dispersion system is actuated. The height position of the beaker is adjusted in such a way that the resonance state of the liquid surface of the aqueous solution in the beaker is maximized.

(5) Ultrasonic waves are applied to the electrolytic aqueous solution in the beaker of the above-described item (4). In this state, about 10 mg of toner is added to the above-described electrolytic aqueous solution little by little and is dispersed. Subsequently, an ultrasonic dispersion treatment is further continued for 60 seconds. In this regard, in the ultrasonic dispersion, the water temperature of the water tank is controlled at 10° C. or higher, and 40° C. or lower appropriately.

(6) The electrolytic aqueous solution, in which the toner is dispersed, of the above-described item (5) is dropped to the round-bottom beaker of the above-described item (1) set in the sample stand by using a pipette in such a way that the measurement concentration is adjusted to become 5%. Then, the measurement is performed until the number of measured particles reaches 50,000.

(7) The measurement data are analyzed by the above-described dedicated software attached to the apparatus, so that the weight average particle diameter (D4) and the number average particle diameter (D1) are calculated. In this regard, when Graph/percent by volume is set in the above-described dedicated software, "Average diameter" on the screen of "Analysis/statistical value on volume (arithmetic average)" is the weight average particle diameter (D4), and when Graph/percent by the number is set in the above-described dedicated software, "Average diameter" on the screen of "Analysis/statistical value on the number (arithmetic average)" is the number average particle diameter (D1).

EXAMPLES

Aspects of the present invention will be specifically described below with reference to production examples and examples. In the present examples, "part" and "%" are on a mass basis unless otherwise explained specifically.

Production of Resin Fine Particle Dispersion Liquid 1

Preparation of Polyester Resin

A reaction container provided with an agitator, a condenser, a thermometer, and a nitrogen introduction tube was charged with the following monomers, 0.03 parts by mass of tetrabutoxy titanate was added, the temperature was raised to 220° C. in a nitrogen atmosphere, and a reaction was effected for 5 hours while agitation was performed.

| | |
|---|---|
| Bisphenol A-propylene oxide 2 mol adduct (BPO-PO): | 49.5 parts by mass |
| Ethylene glycol: | 8.0 parts by mass |
| Terephthalic acid: | 22.3 parts by mass |
| Isophthalic acid | 15.0 parts by mass |
| Trimellitic acid anhydride | 5.2 parts by mass |

Subsequently, the reaction was effected for further 5 hours under reduced pressure of 5 to 20 mmHg in the reaction container, so as to obtain a polyester resin.

Preparation of Resin Fine Particle Dispersion Liquid

A reaction container provided with an agitator, a condenser, a thermometer, and a nitrogen introduction tube was charged with 100.0 parts by mass of the resulting polyester resin, 90.0 parts by mass of tetrahydrofuran, 2.0 parts by mass of diethylamino ethanol (DMAE), and 0.5 parts by mass of sodium dodecylbenzenesulfonate (DBS) and was heated to a temperature of 80° C. to dissolve. Subsequently, 300.0 parts by mass of ion-exchanged water at a temperature of 80° C. was added under agitation, so as to effect dispersion into water. The resulting aqueous dispersion was transferred to a distillation apparatus, and distillation was effected until the fraction temperature reached 100° C. After cooling, ion-exchanged water was added to the resulting aqueous dispersion, so as to adjust the resin concentration in the dispersion to become 20%. In this manner, Resin fine particle dispersion liquid 1 was produced. The properties of the resulting resin fine particles are shown in Table 1.

Production of Resin Fine Particle Dispersion Liquid 2 to 9

Resin fine particle dispersion liquid 2 to 9 were produced as in the production of Resin fine particle dispersion liquid 1 except that the type and the usage of the raw materials were changed as shown in Table 1. The properties of the resulting resin fine particles are shown in Table 1.

TABLE 1

| | Acid component | | | | Alcohol component | | | | Property | | |
|---|---|---|---|---|---|---|---|---|---|---|---|
| | TPA | IPA | TMA | 5-sodium sulfoisophthalic acid | BPA-PO | EG | DMAE | DBS | Acid value (mgKOH/g) | Particle diameter (nm) | Tg (° C.) |
| Resin fine particles 1 | 22.3 | 15.0 | 5.2 | 0.0 | 49.5 | 8.0 | 2.0 | 0.5 | 15.2 | 53 | 66 |
| Resin fine particles 2 | 18.5 | 10.2 | 16.0 | 0.0 | 48.3 | 7.0 | 2.0 | 0.3 | 46.5 | 41 | 65 |
| Resin fine particles 3 | 23.4 | 15.7 | 2.1 | 0.0 | 50.6 | 8.2 | 2.0 | 0.5 | 6.3 | 90 | 64 |
| Resin fine particles 4 | 23.0 | 15.2 | 3.5 | 0.0 | 50.1 | 8.2 | 1.5 | 0.3 | 10.5 | 210 | 65 |
| Resin fine particles 5 | 19.8 | 12.0 | 0.0 | 12.1 | 49.0 | 7.1 | 2.5 | 1.0 | 25.1 | 8 | 66 |
| Resin fine particles 6 | 22.5 | 15.2 | 4.2 | 0.0 | 49.9 | 8.2 | 1.8 | 0.3 | 12.2 | 154 | 66 |
| Resin fine particles 7 | 19.8 | 12.3 | 0.0 | 10.0 | 50.5 | 7.4 | 2.5 | 0.9 | 20.8 | 15 | 65 |
| Resin fine particles 8 | 18.0 | 9.8 | 18.2 | 0.0 | 47.2 | 6.8 | 2.0 | 0.3 | 53.7 | 35 | 64 |
| Resin fine particles 9 | 24.1 | 16.0 | 1.0 | 0.0 | 50.8 | 8.1 | 1.8 | 0.3 | 3.2 | 185 | 65 |

TPA: Terephthalic acid

IPA: Isophthalic acid

TMA: Trimellitic anhydride

BPA-PO: Bisphenol A propylene oxide adduct

EG: Ethylene glycol

DMAE: Diethylamino ethanol

DBS: Sodium dodecylbenzenesulfonate

Production of Polar Resin 1

Preparation of Styrene Acrylic Resin

The following materials were put into a reaction container provided with a reflux cooling tube, an agitator, and a nitrogen introduction tube.

| | |
|---|---|
| Styrene (St): | 80.0 parts by mass |
| Toluene (Tol1): | 100 parts by mass |
| n-Butyl acrylate (BA): | 20.0 parts by mass |
| Methyl methacrylate (MMA): | 2.4 parts by mass |
| Methacrylic acid (MAA): | 1.7 parts by mass |
| Dibutyl peroxide (PBD): | 7.2 parts by mass |

The inside of the above-described container was agitated at 200 revolutions per minute and was heated to 110° C., followed by agitation for 10 hours. Furthermore, heating to 140° C. was performed and polymerization was effected for 6 hours. The solvent was removed by distillation and, thereby, Styrene acrylic resin 1 was obtained. The properties of the resulting Styrene acrylic resin 1 are shown in Table 2.

Production of Polar Resins 2 to 5

Polar resins 2 to 5 were produced as in the production of Polar resin 1 except that the type and the usage of the raw materials were changed as shown in Table 2. The properties of the resulting styrene acrylic resins are shown in Table 2.

TABLE 2

| | St | BA | MMA | MAA | AA | Acid value (mgKOH/g) | Tg (° C.) | Mw |
|---|---|---|---|---|---|---|---|---|
| Styrene acrylic resin 1 | 80.0 | 20.0 | 2.4 | 1.7 | 0 | 10.3 | 67 | 16000 |
| Styrene acrylic resin 2 | 80.0 | 19.0 | 3.5 | 2.0 | 2.2 | 28.5 | 66 | 18000 |
| Styrene acrylic resin 3 | 80.0 | 22.0 | 2.5 | 1.1 | 0 | 7.1 | 65 | 17000 |
| Styrene acrylic resin 4 | 80.0 | 17.0 | 3.6 | 1.8 | 2.9 | 32.4 | 67 | 20000 |
| Styrene acrylic resin 5 | 80.0 | 17.0 | 2.8 | 0.6 | 0 | 4.2 | 70 | 19000 |

St: Styrene
BA: n-Butyl acrylate
MMA: Methyl methacrylate
MAA: Methacrylic acid
AA: Acrylic acid Production of Polar Resin 6

Preparation of Amorphous Polyester Resin 1

The following raw materials were put into a reaction container provided with a cooling tube, an agitator, and a nitrogen introduction tube. A reaction was effected under atmospheric pressure at 260° C. for 8 hours. Thereafter, cooling to 240° C. was performed and pressure was reduced to 1 mmHg over 1 hour. The reaction was effected for further 3 hours so as to obtain an amorphous polyester.

| | |
|---|---|
| Bisphenol A-propylene oxide 2 mol adduct: | 86.0 parts by mass |
| Ethylene glycol: | 65.0 parts by mass |
| Terephthalic acid: | 141.0 parts by mass |
| Trimellitic acid | 29.0 parts by mass |
| Tetrabutyl titanate | 0.28 parts by mass |

Amorphous polyester 1 described above had a weight average molecular weight of 19,000, a glass transition temperature of 72° C., and an acid value of 10.6.

Production of Crystalline Polyester 1

A reaction apparatus provided with an agitator, a thermometer, and an outflow cooler was charged with 175.0 parts of sebacic acid, 63.5 parts of ethylene glycol, and 0.4 parts of tetrabutyl titanate, and an esterification reaction was effected at 190° C. for 5 hours. Thereafter, the temperature was raised to 220° C. and, in addition, the pressure of the inside of the system was reduced gradually, so as to effect a polycondensation reaction at 150 Pa for 2 hours. After the pressure was returned to atmospheric pressure, 24.4 parts of benzoic acid and 10.7 parts of trimellitic acid were added, and the reaction was further effected at 220° C. for 4 hours, so as to obtain Crystalline polyester 1. The properties of the resulting Crystalline polyester 1 are shown in Table 3.

Production of Crystalline Polyesters 2 to 5

Crystalline polyesters 2 to 5 were obtained by effecting the reaction as in the production of Crystalline polyester 1 except that in the production of Crystalline polyester 1, the amount of charge of the monomers and the polycondensation reaction condition after the pressure was returned to atmospheric pressure were changed as shown in Table 3. The properties of the resulting Crystalline polyesters 2 to 5 are shown in Table 3.

TABLE 3

| | Amount of internal addition | | | | | Melting point | Amount of heat | |
|---|---|---|---|---|---|---|---|---|
| | Acid component | Alcohol component | Others | Tetrabutyl titanate | Polycondensation step condition | Tm1 (° C.) | absorption (J/g) | Acid value (mgKOH/g) |
| Crystalline polyester 1 | sebacic acid 175.0 parts | ethylene glycol 63.5 parts | benzoic acid 24.4 parts trimellitic acid 10.7 parts | 0.4 parts | 220° C. 4 hours | 72.1 | 105 | 11.5 |
| Crystalline polyester 2 | 1,10-decanedicarboxylic acid 231.0 parts | diethylene glycol 107.5 parts | benzoic acid 24.4 parts trimellitic acid 4.5 parts | 0.4 parts | 220° C. 7 hours | 91.3 | 130 | 5.3 |
| Crystalline polyester 3 | adipic acid 146.1 parts | diethylene glycol 108.2 parts | benzoic acid 24.4 parts | 0.6 parts | 220° C. 2 hours | 57.4 | 102 | 35.0 |

TABLE 3-continued

| | Amount of internal addition | | | | | Melting point | Amount of heat | |
|---|---|---|---|---|---|---|---|---|
| | Acid component | Alcohol component | Others | Tetrabutyl titanate | Polycondensation step condition | Tm1 (° C.) | absorption (J/g) | Acid value (mgKOH/g) |
| | | | trimellitic acid 31.5 parts | | | | | |
| Crystalline polyester 4 | succinic acid 118.1 parts | 1,4-butane diol 91.9 parts | benzoic acid 24.4 parts trimellitic acid 4.2 parts | 0.2 parts | 220° C. 9 hours | 96.2 | 146 | 4.9 |
| Crystalline polyester 5 | adipic acid 146.1 parts | diethylene glycol 110.5 parts | benzoic acid 24.4 parts trimellitic acid 20.5 parts | 0.2 parts | 220° C. 9 hours | 53.1 | 118 | 16.5 |

Example 1

Preparation of Toner 1

Preparation of Core Particle

A mixture of monomers composed of

| | |
|---|---|
| Styrene: | 74.0 parts |
| n-Butyl acrylate: | 26.0 parts |
| Pigment Blue 15:3: | 6.0 parts |
| Aluminum salicylate compound (BONTRON E-88: produced by Orient Chemical Industries, Ltd.) | 1.2 parts |
| Divinyl benzene: | 0.04 parts |
| Release agent paraffin wax: (HNP-51: produced by NIPPON SEIRO CO., LTD. melting point 74° C.) | 9.0 parts |
| Polar resin 1: | 15.0 parts |
| Crystalline polyester 1: | 10.0 parts |

was prepared. A monomer composition was obtained by putting 15 mm ceramic beads into the mixture and performing dispersion for 2 hours through the use of an attritor (produced by Mitsui Miike Chemical Engineering Machinery Co., Ltd.). A dispersion medium system was prepared by adding 800.0 parts of ion-exchanged water and 3.5 parts of tricalcium phosphate to a container provided with a high-speed agitator TK-HOMOMIXER (produced by Tokushu Kika Kogyo Co., Ltd.), adjusting the number of revolutions at 12,000 revolutions/min, and heating up to 80° C. The monomer composition was blended with 7.5 parts of t-butyl peroxypivalate serving as a polymerization initiator, and this was put into the above-described dispersion medium system. A granulation step was performed for 5 minutes while 12,000 revolutions/min was maintained with the above-described high-speed agitator. Thereafter, the agitation machine was switched from the high-speed agitator to a propeller agitating blade, and the polymerization was effected for 8 hours while agitation was performed at 150 revolutions/min and 80° C. was maintained. After the polymerization was finished, the resulting dispersion liquid of polymer particles was cooled to 30° C. at a rate of 0.5° C./min, and ion-exchanged water was added to adjust the polymer particle concentration in the dispersion liquid to become 20%, so that a core particle dispersion liquid was obtained.

Fixing of Resin Fine Particles

A reaction container provided with a reflux cooling tube, an agitator, and a thermometer was charged with 500.0 parts (solid content 100.0 parts) of the core particle dispersion liquid, 25.0 parts (solid content 5.0 parts) of Resin fine particle dispersion liquid 1 was added gradually under agitation, and agitation was performed at 200 revolutions/min for 15 minutes. Subsequently, the temperature of the dispersion liquid of the core particles, to which the resin fine particles were attached, was kept at 55° C. by using an oil bath for heating, 0.3 mol/L hydrochloric acid was dropped at a dropping rate of 1.0 part/min and, thereby, the pH of the above-described dispersion liquid was adjusted to become 1.5. Thereafter, agitation was continued for 2 hours. Then, 1.0 mol/L sodium hydroxide aqueous solution was dropped under agitation until the pH of the above-described dispersion liquid reached 7.5. This dispersion liquid was kept at 66° C., which was the glass transition temperature of the resin fine particles, and agitation was further performed for 1 hour. After the above-described dispersion liquid was cooled to 20° C., dilute hydrochloric acid was added until the pH reached 1.5. Furthermore, washing with ion-exchanged water was performed sufficiently, and filtration, drying and classification were performed, so as to obtain Toner particle 1.

Hydrophobic silica fine powder having a primary particle diameter of 12 nm and a Bet specific surface area of 120 $m^2/g$ was prepared by treating 100 parts of silica fine powder with 10 parts of hexamethyldisilazane and further treating with 10 parts of silicone oil. Subsequently, Toner 1 described above was classified and, thereafter, 100.0 parts thereof was weighed, 1.0 part of the hydrophobic silica fine powder was added, and mixing was performed by using Henschel mixer (produced by Mitsui Miike Chemical Engineering Machinery Co., Ltd.), so as to obtain Toner 1. The properties of the resulting Toner 1 are shown in Table 4 and Table 5.

Examples 2 to 16, Comparative Examples 1 to 6

Toner particles and Toners 2 to 16 and 18 to 23 were obtained as in Example 1 except that the type and the usage of the raw materials, the polymerization condition, and the fixing condition in Example 1 were changed as shown in Table 4. The properties of the resulting Toners 2 to 16 and 18 to 23 are shown in Table 4 and Table 5.

Example 17

Preparation of Toner 17

A core particle dispersion liquid was obtained as in Example 1. Dilute hydrochloric acid was added to the core particle dispersion liquid until the pH reached 1.5. Furthermore, washing with ion-exchanged water was performed sufficiently, and filtration and drying were performed, so as to obtain core particle. Then, Resin fine particle dispersion liquid 1 was washed with ion-exchanged water sufficiently and, thereafter, filtration, drying, and freeze pulverization were performed. Toner particle 17 was obtained by adding 5.0 parts of freeze-pulverized product of Resin fine particles 1, described above, to 100 parts of the above-described core particle and performing fixing through the use of an impact surface treatment apparatus (treatment temperature 50° C., rotary treatment blade 90 m/sec).

Subsequently, Toner 17 was obtained by performing the external addition and a classification treatment in a manner similar to that in Example 1. The properties of the toner were measured by using the above-described methods. The results are shown in Table 4 and Table 5.

Comparative Example 7

| Preparation of resin dispersion liquid A | |
|---|---|
| Styrene: | 292 parts |
| Butyl acrylate: | 88 parts |
| Acrylic acid: | 8 parts |
| Dodecyl mercaptan: | 4 parts |

A solution (a) was prepared by mixing and dissolving the above-described materials in advance. Meanwhile, a solution (b) was prepared by dissolving 7 parts of nonionic surfactant (trade name: NONIPOL, produced by Sanyo Chemical Industries, Ltd.) and 10 parts of anionic surfactant (trade name: Neogen R, produced by Dai-ichi Kogyo Seiyaku Co., Ltd.) into 520 parts of ion-exchanged water. The solutions (a) and (b) were put into a flask, emulsification was effected through dispersion, and mixing was performed for 10 minutes slowly. Furthermore, 50 g of ion-exchanged water including 6 parts of ammonium persulfate dissolved was added thereto and replacement with nitrogen was performed. Thereafter, the flask was heated under agitation with an oil bath until the contents reached 90° C., and emulsion polymerization was continued as-is for 6 hours. Then, the resulting reaction solution was cooled to room temperature so as to obtain Resin dispersion liquid A.

| Preparation of Colorant dispersion liquid A | |
|---|---|
| Pigment Blue 15:3: | 70 parts |
| Anionic surfactant (trade name: Neogen, produced by Daiichi Kogyo Seiyaku Co., Ltd.): | 3 parts |
| Ion-exchanged water: | 400 parts |

After the above-described components were mixed and dissolved, dispersion liquid was performed by using a homogenizer (Ultra Turrax, produced by IKA), so as to obtain Colorant dispersion liquid A.

| Preparation of Release agent dispersion liquid A | |
|---|---|
| Paraffin wax (HNP-5: produced by NIPPON SEIRO CO., LTD., melting point 60° C.): | 100 parts |
| Anionic surfactant (trade name: Pionin A-45-D, produced by TAKEMOTO OIL & FAT Co., Ltd.): | 2 parts |
| Ion-exchanged water: | 500 parts |

After the above-described components were mixed and dissolved, dispersion was performed by using a homogenizer (Ultra-Turrax, produced by IKA). Then, a dispersion treatment was performed with a pressure discharge type homogenizer, so as to obtain Release agent dispersion liquid A in which release agent fine particles (paraffin wax) are dispersed.

Preparation of Crystalline Polyester Dispersion Liquid A

After 200 parts of Crystalline polyester 1 described above was put into 800 parts of distilled water and was heated to 80° C., the pH was adjusted to become 9.0 with ammonia, and 0.4 parts (as an effective component) of an anionic surfactant (Neogen RK, produced by Dai-ichi Kogyo Seiyaku Co., Ltd.) was added. Crystalline polyester dispersion liquid A was obtained by dispersing with a homogenizer (Ultra-Turrax T50, produced by IKA Japan) at 8,000 rpm for 7 minutes while heating to 80° C. was performed.

| Production example of Toner 24 | |
|---|---|
| Resin dispersion liquid A: | 300 parts |
| Colorant dispersion liquid A: | 50 parts |
| Release agent dispersion liquid A | 60 parts |
| Crystalline polyester dispersion liquid A | 60 parts |
| Cationic surfactant (trade name: SANISOL B50, produced by Kao Corporation): | 4 parts |
| Ion-exchanged water: | 500 parts |

The above-described components were mixed and dispersed in a round-bottom stainless steel flask by using a homogenizer (trade name: Ultra-Turrax T50, produced by IKA). The prepared mixture was heated to 50° C. with an oil bath for heating under agitation and was kept at 50° C. for 30 minutes, so as to form aggregated particles. Subsequently, 6 parts of sodium dodecylbenzenesulfonate (trade name: Neogen SC, produced by Dai-ichi Kogyo Seiyaku Co., Ltd.) serving as an anionic surfactant was added to the aggregated particle dispersion liquid and heating to 60° C. was performed. Sodium hydroxide was further added appropriately and, thereby, the pH in the system was kept at 4.0 or less, the system was kept as-is for 3 hours to fuse the aggregated particle. Thereafter, cooling to 45° C. was performed at a cooling rate of 1.0° C./min. After filtration, washing with ion-exchanged water was performed sufficiently, and a core particle dispersion liquid was obtained by adding ion-exchanged water in such a way that the aggregated particle concentration in the dispersion liquid was adjusted to become 20%.

Fixing of Resin Fine Particles

A reaction container provided with a reflux cooling tube, an agitator, and a thermometer was charged with 500.0 parts (solid content 100.0 parts) of the core particle dispersion liquid, 25.0 parts (solid content 5.0 parts) of Resin fine particle dispersion liquid 1 was added gradually under agitation, and agitation was performed at 200 revolutions/min for 15 minutes. Subsequently, the temperature of the above-described dispersion liquid was kept at 60° C. by using an oil bath for heating, 0.3 mol/L hydrochloric acid was dropped at a dropping rate of 1.0 part/min and, thereby, the pH of the above-described dispersion liquid was adjusted to become 1.5. Thereafter, agitation was continued for 2 hours. After the above-described dispersion liquid was cooled to 20° C., washing with ion-exchanged water was performed sufficiently, and filtration, drying and classification were performed, so as to obtain Toner particle 24. Subsequently, Toner 24 was obtained by performing the external addition and a classification treatment in a manner similar to that in Example 1. The properties of the toner were measured by using the above-described methods. The results are shown in Table 4 and Table 5.

TABLE 4

| | | Polymerization | | | | | Fixing | | Property | | |
|---|---|---|---|---|---|---|---|---|---|---|---|
| Example | Toner | Polar resin | parts | Crystalline polyester | parts | Polymerization temperature (° C.) | Resin fine particles | parts | Tg (° C.) | D4 (μm) | D4/D1 |
| Example 1 | Toner 1 | styrene acrylic resin 1 | 15.0 | 1 | 10.0 | 80 | 1 | 5.0 | 51.5 | 6.2 | 1.22 |
| Example 2 | Toner 2 | styrene acrylic resin 1 | 15.0 | 1 | 10.0 | 80 | 2 | 5.0 | 51.1 | 6.3 | 1.21 |
| Example 3 | Toner 3 | styrene acrylic resin 1 | 15.0 | 1 | 10.0 | 80 | 3 | 5.0 | 50.9 | 6.4 | 1.20 |
| Example 4 | Toner 4 | amorphous polyester resin 1 | 7.0 | 1 | 10.0 | 80 | 1 | 5.0 | 51.3 | 6.3 | 1.19 |
| Example 5 | Toner 5 | amorphous polyester resin 1 | 7.0 | 2 | 10.0 | 95 | 1 | 5.0 | 52.6 | 6.2 | 1.22 |
| Example 6 | Toner 6 | amorphous polyester resin 1 | 7.0 | 3 | 10.0 | 70 | 1 | 5.0 | 50.5 | 6.1 | 1.23 |
| Example 7 | Toner 7 | amorphous polyester resin 1 | 7.0 | 4 | 10.0 | 98 | 1 | 5.0 | 52.3 | 6.5 | 1.24 |
| Example 8 | Toner 8 | amorphous polyester resin 1 | 7.0 | 5 | 10.0 | 70 | 1 | 5.0 | 50.2 | 5.9 | 1.21 |
| Example 9 | Toner 9 | styrene acrylic resin 2 | 0.5 | 1 | 10.0 | 80 | 1 | 5.0 | 49.8 | 6.8 | 1.26 |
| Example 10 | Toner 10 | styrene acrylic resin 3 | 32.0 | 1 | 10.0 | 80 | 1 | 5.0 | 53.3 | 6.0 | 1.20 |
| Example 11 | Toner 11 | styrene acrylic resin 4 | 3.0 | 1 | 10.0 | 80 | 1 | 5.0 | 50.3 | 7.2 | 1.34 |
| Example 12 | Toner 12 | styrene acrylic resin 5 | 27.0 | 1 | 10.0 | 80 | 1 | 5.0 | 52.9 | 6.7 | 1.27 |
| Example 13 | Toner 13 | styrene acrylic resin 1 | 15.0 | 1 | 28.0 | 80 | 4 | 10.0 | 50.1 | 6.2 | 1.24 |
| Example 14 | Toner 14 | styrene acrylic resin 1 | 15.0 | 1 | 4.0 | 80 | 5 | 1.5 | 52.0 | 6.5 | 1.23 |
| Example 15 | Toner 15 | styrene acrylic resin 1 | 15.0 | 1 | 33.0 | 80 | 6 | 7.0 | 49.5 | 6.6 | 1.28 |
| Example 16 | Toner 16 | styrene acrylic resin 1 | 15.0 | 1 | 1.0 | 80 | 7 | 3.0 | 52.3 | 6.1 | 1.21 |
| Example 17 | Toner 17 | styrene acrylic resin 1 | 15.0 | 1 | 10.0 | 80 | 1 | 5.0 | 51.7 | 6.3 | 1.21 |
| Comparative example 1 | Toner 18 | styrene acrylic resin 1 | 15.0 | 1 | 10.0 | 65 | 1 | 5.0 | 50.7 | 6.6 | 1.28 |
| Comparative example 2 | Toner 19 | styrene acrylic resin 1 | 15.0 | 1 | 10.0 | 65 | 8 | 5.0 | 51.8 | 6.8 | 1.27 |
| Comparative example 3 | Toner 20 | styrene acrylic resin 1 | 15.0 | 1 | 10.0 | 65 | 9 | 5.0 | 52.1 | 6.6 | 1.28 |
| Comparative example 4 | Toner 21 | styrene acrylic resin 1 | 15.0 | 1 | 10.0 | 65 | — | — | 51.0 | 6.7 | 1.26 |
| Comparative example 5 | Toner 22 | amorphous polyester resin 1 | 7.0 | — | — | 80 | 4 | 5.0 | 52.5 | 6.2 | 1.23 |
| Comparative example 6 | Toner 23 | — | — | 1 | 10.0 | 80 | 1 | 5.0 | 49.6 | 7.8 | 1.38 |
| Comparative example 7 | Toner 24 | (produced by emulsion aggregation method) | | | | | 1 | 5.0 | 57.6 | 6.3 | 1.27 |

TABLE 5

| Example | Toner | La | Lb | La/Lb |
|---|---|---|---|---|
| Example 1 | Toner 1 | 570 | 31 | 18 |
| Example 2 | Toner 2 | 580 | 33 | 18 |
| Example 3 | Toner 3 | 575 | 29 | 20 |
| Example 4 | Toner 4 | 590 | 41 | 14 |
| Example 5 | Toner 5 | 760 | 43 | 18 |
| Example 6 | Toner 6 | 310 | 22 | 14 |
| Example 7 | Toner 7 | 890 | 48 | 19 |
| Example 8 | Toner 8 | 850 | 46 | 18 |
| Example 9 | Toner 9 | 860 | 47 | 18 |
| Example 10 | Toner 10 | 680 | 37 | 18 |
| Example 11 | Toner 11 | 720 | 43 | 17 |
| Example 12 | Toner 12 | 660 | 36 | 18 |
| Example 13 | Toner 13 | 640 | 34 | 19 |
| Example 14 | Toner 14 | 590 | 31 | 19 |
| Example 15 | Toner 15 | 680 | 42 | 16 |
| Example 16 | Toner 16 | 590 | 30 | 20 |
| Example 17 | Toner 17 | 565 | 32 | 18 |
| Comparative example 1 | Toner 18 | 1200 | 350 | 3.4 |
| Comparative example 2 | Toner 19 | 1200 | 330 | 3.6 |
| Comparative example 3 | Toner 20 | 1200 | 340 | 3.5 |
| Comparative example 4 | Toner 21 | 1200 | 330 | 3.6 |
| Comparative example 5 | Toner 22 | — | — | — |
| Comparative example 6 | Toner 23 | 880 | 92 | 9.6 |
| Comparative example 7 | Toner 24 | 130 | 68 | 1.9 |

Regarding each of Toners obtained in Examples 1 to 17 and Comparative examples 1 to 7, the performance was evaluated on the basis of the following methods. The results are collectively shown in Table 6.

Production Stability

The production stability was evaluated by evaluating the ratio D4/D1 of the volume average particle diameter D4 to the number average particle diameter D1 in the particle size distribution of the resulting toner. The D4/D1 was evaluated on the basis of the following evaluation criteria.

A: D4/D1 is less than 1.25

B: D4/D1 is 1.25 or more, and less than 1.30

C: D4/D1 is 1.30 or more, and less than 1.35

D: D4/D1 is 1.35 or more, and less than 1.40

E: D4/D1 is 1.40 or more

Thermal Storage Resistance

A plastic cup having a volume of 100 ml was charged with 5 g of toner through weighing. This was put into a constant temperature bath having an internal temperature of 50° C. and was stood for 30 days. Thereafter, the plastic cup was taken out, and changes in the state of the toner therein were evaluated visually. The evaluation criteria are as described below.

A: Aggregate is not observed.

B: Aggregates are observed, but are loosened easily.

C: Aggregates are observed to a somewhat large extent, but are loosened on impact.

D: aggregates are observed to a large extent and are not loosened easily.

E: Aggregates are observed significantly and are hardly loosened.

Low-Temperature Fixability

A commercially available color laser printer (LBP-7700C, produced by CANON KABUSHIKI KAISHA) was used. The toner of a cyan cartridge was taken out, and the toner produced in the above-described example or comparative example was filled into the cartridge, and the resulting cartridge was mounted on the cyan station. Then, an unfixed toner image (0.6 mg/cm$^2$) of 2.0 cm long and 15.0 cm wide was formed in a portion at 1.0 cm from an upper end in the paper running direction on the image receiving paper (Office Planner produced by CANON KABUSHIKI KAISHA 64 g/m$^2$). Subsequently, the fixing unit taken from the commercially available color laser printer (LBP-7700C, produced by CANON KABUSHIKI KAISHA) was modified in such a way that the fixing temperature and the process speed can be controlled, and a fixing test of the unfixed image was performed by using this.

Initially, at ambient temperature and room humidity, the process speed was set at 200 mm/s, the initial temperature was specified to be 110° C., and the set temperature was raised by 5° C. sequentially, while fixing of the above-described unfixed image was performed at each temperature. The temperature, at which low-temperature offset was not observed and, in addition, the rate of reduction in concentration between before and after rubbing became 10% or less, where the resulting fixed image was rubbed with silbon paper under a load of 4.9 kPa (50 g/cm$^2$), was specified to be a low-temperature side fixing start temperature. The evaluation criteria of the low-temperature fixability are as described below.

A: The low-temperature side start temperature is 120° C. or lower.

B: The low-temperature side start temperature is 125° C.

C: The low-temperature side start temperature is 130° C.

D: The low-temperature side start temperature is 135° C.

E: The low-temperature side start temperature is 140° C. or higher.

Durability

A color laser printer (LBP-7700C, produced by CANON KABUSHIKI KAISHA) was used. The toner of a cyan cartridge was taken out, and 80 g of the toner produced in the above-described example or comparative example was filled into the cartridge. Thereafter, the resulting cartridge was stood for 30 days in an environment at an temperature of 35° C. and a humidity of 90% RH. Subsequently, the resulting cartridge was mounted on the cyan station of the printer, and at ambient temperature and room humidity (23° C., 60% RH), the image receiving paper (Office Planner produced by CANON KABUSHIKI KAISHA 64 g/m$^2$) was used, and 7,000 sheets of chart with a coverage of 2% were output continuously. The process speed was specified to be 180 mm/s. After 7,000 sheets were output continuously, a 30H image was formed. The resulting image was observed visually, and the reproducibility of solid uniformity of the above-described image was evaluated on the basis of the following indicators. In this regard, the 30H image refers to a halftone image, where 256 levels of gray are expressed by hexadecimal numbers, OOH represents solid white, and FFH represents a solid image.

A: There is no streak nor variation on the image (the durability is particularly excellent)

B: There is no streak on the image, but variations are observed slightly (the durability is excellent)

C: There are 1 to 3 thin streaks on the image, and variations are observed (the durability has no problem)

D: There are at least 4 thin streaks on the image, and variations are observed (the durability is poorer than that in the item C)

E: There are a large extent of streaks and variations on the image (the durability is poorer than that in the item D)

Then, a white image was further output, and the reflectance thereof was measured. The fogging concentration was determined by subtracting the reflectance of the unused paper from the reflectance of the white image. As for the measurement of the reflectance, TC-6DS (produced by Tokyo Denshoku Co., Ltd.) was used.

A: The fogging concentration is less than 1.0% (the chargeability is particularly excellent)

B: The fogging concentration is 1.0% or more, and less than 1.5% (the chargeability is excellent)

C: The fogging concentration is 1.5% or more, and less than 2.0% (the chargeability is good)

D: The fogging concentration is 2.0% or more, and less than 2.5% (the chargeability is somewhat poor)

E: The fogging concentration is 2.5% or more (the chargeability is poor)

Next, the toner of a cyan cartridge of a color laser printer (LBP-7700C, produced by CANON KABUSHIKI KAISHA) was taken out, and 70 g of toner was filled into the cartridge. The resulting cartridge was stood for 30 days in an environment at an temperature of 35° C. and a humidity of 90% RH. Subsequently, a commercially available color laser printer (LBP-7700C, produced by CANON KABUSHIKI KAISHA) was modified in such a way that the process speed can be controlled at 240 mm/sec, and the cartridge was mounted on the cyan station of the printer. At ambient temperature and room humidity (23° C., 60% RH), the image receiving paper (Office Planner produced by CANON KABUSHIKI KAISHA 64 g/m$^2$) was used, and 6,000 sheets of chart with a coverage of 2% were output continuously. The resulting image quality was evaluated on the basis of the evaluation criteria described below.

After 6,000 sheets were output continuously, a 30H image was formed. The resulting image was observed visually, and the reproducibility of solid uniformity of the above-described image was evaluated on the basis of the indicators described below. In this regard, the 30H image refers to a halftone image, where 256 levels of gray are expressed by hexadecimal numbers, OOH represents solid white, and FFH represents a solid image.

Evaluation was performed on the basis of the following evaluation criteria.

A: There is no streak nor variation on the image (the durability is particularly excellent)

B: There is no streak on the image, but variations are observed slightly (the durability is excellent)

C: There are 1 to 3 thin streaks on the image, and variations are observed (the durability has no problem)

D: There are at least 4 thin streaks on the image, and variations are observed (the durability is poorer than that in the item C)

E: There are a large extent of streaks and variations on the image (the durability is poorer than that in the item D)

Furthermore, a white image was output, and the reflectance thereof was measured. The reflectance of the unused paper was measured and was subtracted from the value of the white image, so that the fogging concentration was determined. The reflectance was measured with TC-6DS (produced by Tokyo Denshoku Co., Ltd.).

A: The fogging concentration is less than 1.0% (the chargeability is particularly excellent)

B: The fogging concentration is 1.0% or more, and less than 1.5% (the chargeability is excellent)

C: The fogging concentration is 1.5% or more, and less than 2.0% (the chargeability is good)

D: The fogging concentration is 2.0% or more, and less than 2.5% (the chargeability is somewhat poor)

E: The fogging concentration is 2.5% or more (the chargeability is poor)

State of Coverage with Outer Shell

The state of coverage with the outer shell was evaluated on the basis of observation of the TEM sectional view of the toner.

A: The whole surface of the core particle is covered with the outer shell

B: The core particle remarkably has portions not covered with the outer shell

C: The core particle has no outer shell

TABLE 6

| Example | Toner | Production stability | Fixability | Thermal storage resistance | Durability: Image quality at normal speed | Durability: Fogging at normal speed | Durability: Image quality at high speed | Durability: Fogging at high speed | Durability: State of coverage |
|---|---|---|---|---|---|---|---|---|---|
| Example 1 | Toner 1 | A | A(120) | A | A(0) | A(0.4) | A(0) | A(0.5) | A |
| Example 2 | Toner 2 | A | A(120) | A | A(0) | A(0.6) | B(0) | B(1.1) | A |
| Example 3 | Toner 3 | A | A(120) | A | A(0) | A(0.7) | B(0) | B(1.2) | A |
| Example 4 | Toner 4 | A | A(120) | A | B(0) | B(1.1) | C(1) | C(1.5) | A |
| Example 5 | Toner 5 | A | B(125) | A | B(0) | B(1.2) | C(1) | C(1.6) | A |
| Example 6 | Toner 6 | A | A(120) | B | B(0) | B(1.3) | C(1) | C(1.7) | A |
| Example 7 | Toner 7 | A | C(130) | A | B(0) | B(1.2) | C(1) | C(1.6) | A |
| Example 8 | Toner 8 | A | A(120) | C | B(0) | B(1.4) | C(1) | C(1.7) | A |
| Example 9 | Toner 9 | B | A(120) | B | C(2) | B(1.4) | C(2) | C(1.8) | A |
| Example 10 | Toner 10 | A | C(130) | A | A(0) | A(0.7) | A(0) | B(1.3) | A |
| Example 11 | Toner 11 | C | A(120) | A | B(0) | A(0.9) | B(0) | B(1.3) | A |
| Example 12 | Toner 12 | B | B(125) | B | A(0) | A(0.8) | A(0) | C(1.7) | A |
| Example 13 | Toner 13 | A | A(120) | B | B(0) | A(0.8) | B(0) | C(1.6) | A |
| Example 14 | Toner 14 | A | B(125) | C | C(2) | B(1.3) | C(2) | B(1.4) | A |
| Example 15 | Toner 15 | B | A(120) | C | B(0) | A(0.6) | C(1) | B(1.3) | A |
| Example 16 | Toner 16 | A | C(130) | B | B(0) | B(1.2) | B(0) | C(1.6) | A |
| Example 17 | Toner 17 | A | A(120) | C | C(3) | B(1.4) | C(3) | C(1.8) | A |
| Comparative example 1 | Toner 18 | B | B(125) | B | B(0) | B(1.3) | D(5) | D(2.1) | A |
| Comparative example 2 | Toner 19 | B | B(125) | B | C(1) | C(1.6) | D(5) | D(2.3) | B |
| Comparative example 3 | Toner 20 | B | B(125) | C | C(3) | D(2.1) | D(7) | D(2.4) | B |
| Comparative example 4 | Toner 21 | B | B(125) | E | E(10) | D(2.4) | E(13) | D(2.4) | C |
| Comparative example 5 | Toner 22 | A | C(130) | C | C(2) | C(1.7) | C(3) | C(1.8) | A |
| Comparative example 6 | Toner 23 | D | B(125) | C | D(5) | C(1.7) | D(6) | D(2.3) | B |
| Comparative example 7 | Toner 24 | B | B(125) | D | D(6) | D(2.4) | E(12) | E(2.8) | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-134312 filed Jun. 11, 2010, which is hereby incorporated by reference herein in its entirety.

What is claimed is:

1. A toner comprising:

a core particle, and an amorphous outer shell covering the whole surface of the core particle, wherein:

the core particles comprises a binder resin, a colorant, a releasing agent and a polar resin, and wherein:

the core particle further comprises a crystalline polyester dispersed therein, and the crystalline polyester in the core particle satisfies the following relationship:

310 nm≦La≦1000 nm;

22 nm≦Lb≦50 nm;

La/Lb≧10, wherein La and Lb respectively represent a length and a width of the crystalline polyester dispersed in the core particle observed in a cross-section of the toner with an transmission electron microscope.

2. The toner according to claim 1, wherein the amorphous outer shell is disposed through attachment of amorphous resin fine particles to the surface of the core particle.

3. The toner according to claim 2, wherein the acid value of the resin fine particles is 4.0 to 50.0 mgKOH/g.

4. The toner according to claim 1, wherein the polar resin is a styrene acrylic resin.

5. A method for manufacturing a toner according to claim 1 comprising the steps of:

preparing a polymerizable monomer composition containing a polymerizable monomer, the colorant, the releasing agent, the polar resin, and the crystalline polyester;

adding the polymerizable monomer composition to an aqueous medium;

granulating the polymerizable monomer composition in the aqueous medium;

polymerizing the polymerizable monomer in the polymerizable monomer composition so as to obtain the core particle;

adding resin fine particles to the aqueous medium; and attaching the resin fine particles to the surface of the core particle to form the amorphous outer shell covering the whole surface of the core particle, wherein the acid value of the resin fine particles is 4.0 to 50.0 mgKOH/g.

6. The method for manufacturing a toner according to claim 5, wherein the polar resin is a styrene acrylic resin, and the acid value of the polar resin is 5.0 to 30.0 mgKOH/g.

7. The method for manufacturing a toner according to claim 5, wherein the melting point Tm1 (° C.) of the crystalline polyester is 55.0° C. to 95.0° C.

8. The method for manufacturing a toner according to claim 7, wherein the polymerizable monomer in the polymerizable monomer composition is polymerized at a polymerization temperature equal to or higher than the Tm1 (° C.).

* * * * *